US005637956A

United States Patent [19]

Sugiyama et al.

[11] Patent Number: 5,637,956

[45] Date of Patent: Jun. 10, 1997

[54] COLOR CATHODE RAY TUBE WITH REDUCED HALO

[75] Inventors: Mitsuhiro Sugiyama; Satoru Endo; Mamoru Ikeda, all of Mobara; Masayoshi Misono, Chiba-ken, all of Japan

[73] Assignee: Hitachi, Ltd., Tokyo, Japan

[21] Appl. No.: 262,974

[22] Filed: Jun. 21, 1994

[30] Foreign Application Priority Data

Jul. 14, 1993 [JP] Japan ..... 5-174332

[51] Int. Cl.[6] ..... H01J 29/56

[52] U.S. Cl. ..... 313/447; 313/449; 313/414

[58] Field of Search ..... 313/447, 449, 313/448, 414

[56] References Cited

U.S. PATENT DOCUMENTS 4,242,613 12/1980 Brambring et al. ..... 313/447
4,251,747 2/1981 Burdick ..... 313/447
4,358,703 11/1982 Bijma et al. ..... 313/448
4,886,998 12/1989 Endo ..... 313/447

FOREIGN PATENT DOCUMENTS 3741202 6/1988 Germany ..... 313/414
60-59637 4/1985 Japan .

*Primary Examiner*—Sandra L. O'Shea
*Assistant Examiner*—Matthew J. Esserman
*Attorney, Agent, or Firm*—Antonelli, Terry, Stout & Kraus, LLP

[57] ABSTRACT

An electron beam aperture of a second grid electrode of a color cathode ray tube is a rectangular hole formed in the center of a slit-like recess having longer sides extending in the horizontal direction. The vertical width of the rectangular hole is greater than the width of each shorter side of the slit-like recess.

13 Claims, 7 Drawing Sheets

COLOR CATHODE RAY TUBE WITH REDUCED HALO

BACKGROUND OF THE INVENTION

1. Field of the Invention

The present invention relates to an electron gun having an electrode structure with an improved focusing characteristic and to a color cathode ray tube using such an electron gun.

2. Description of the Prior Art

In general, in a color cathode ray tube such as a color cathode ray tube or a color monitor tube, to implement a so-called self-convergence function which causes a plurality of electron beams to converge on a phosphor screen without a special external correcting magnetic field being applied to them, deflection magnetic fields for deflecting the electron beams emitted from an electron gun are given predetermined distortions.

For this reason, the electron beams are subjected to deflection distortion while passing through the deflection magnetic fields, and form beam spots accompanied by haloes in the direction perpendicular to scanning lines, in the peripheral portion of the phosphor screen particularly in each corner portion of the screen. Thus, the focusing characteristic of the electron gun is degraded in such portions and, hence, the image quality is degraded.

To attain the uniformity of the focusing characteristic over the entire screen, recesses each having a rectangular shape, i.e., so-called slits, are formed in a second grid electrode of the electron gun in such a manner that electron beam apertures are respectively located in the slit-shaped recesses.

FIGS. 1(*a*) and 1(*b*) are explanatory views showing the structure of the second grid electrode used in the above-described conventional electron gun. FIG. 1(*a*) is a front view viewed from the first grid electrode side, and FIG. 1(*b*) is a cross-sectional view taken along the line I(b)—I(b) in FIG. 1(*a*).

An electron beam aperture 1*a* of a second grid electrode 2 is a circular hole which pierces the center of a slit-shaped recess 1*b* formed and elongated horizontally in a plate which constitutes the second grid electrode. The diameter of the electron beam aperture 1*a* is smaller than the length of each shorter side of the slit-like recess 1*b*. The slit-like recess 1*b* is formed by coining in the plate which constitutes the second grid electrode, so that the slit-like recess 1*b* has a substantially rectangular cross section which flares outwardly to a small extent from the bottom of the recess toward the open end, as shown in FIG. 1(*b*).

Specifically, in the shown conventional electrode structure, there is a distance d1 in the vertical direction between each longer side of the slit-like recess 1*b* and the edge of the electron beam aperture 1*a* at the bottom of the slit-like recess 1*b*. As a result, the effect of suppressing haloes in the vertical direction which occur during scanning of the periphery of the screen is weakened.

To solve the above-described problem, an electrode structure which will be described below has been proposed.

FIGS. 2(*a*) and 2(*b*) are explanatory views showing the structure of a second grid electrode used in another conventional electron gun. FIG. 2(*a*) is a front view of an electron beam aperture portion, and FIG. 2(*b*) is a cross-sectional view taken along the line II(b)—II(b) in FIG. 2(*a*).

This second grid electrode is made up of a first member 2-1 and a second member 2-2 which are fixedly bonded to each other, such as by welding. The first member 2-1 has a slit 1*b* formed by press cutting, while the second member 2-2 has a circular electrode beam aperture 1*a* having a diameter of the same size as the length of each vertical (shorter) side of the slit lb.

By adopting such an arrangement, it is possible to reduce each of the distances d1 shown in FIG. 1(*a*) to zero, whereby it is possible to retain the aforesaid halo suppressing effect in the peripheral portions of the screen.

To achieve a similar object, the electrode structure shown in FIGS. 3(*a*) and 3(*b*) is disclosed in Japanese Patent Laid-Open No. 60-59637 corresponding to Japanese Patent Application No. 58-164958.

FIGS. 3(*a*) and 3(*b*) are explanatory views partially showing the structure of a second grid electrode used in still another conventional electron gun. FIG. 3(*a*) is a front view of an electron beam aperture portion, and FIG. 3(*b*) is a cross-sectional view taken along the line III(b)—III(b) in FIG. 3(*a*).

In this electrode structure, the diameter of the electrode beam aperture 1*a* is greater than each shorter side of the slit-like recess 1*b* and the vertical wall portions of the slit-like recess 1*b* are shared by the electron beam aperture 1*a*. Accordingly, it is possible to obtain an effect similar to that described above with reference to FIGS. 2(*a*) and 2(*b*).

SUMMARY OF THE INVENTION

However, the above-described prior art electrode structures still involve the following problems.

In the case of the electrode structure shown in FIGS. 2(*a*) and 2(*b*) formed by bonding the two members 2-1 and 2-2, during welding of both members 2-1 and 2-2, misalignment can occur between the slit 1*b* and the electron beam aperture 1*a*. Particularly if a vertical misalignment occurs, the effect of suppressing vertical haloes becomes unbalanced between the upper and lower portions of the electron beam aperture 1*a*, and the focusing characteristic is deteriorated.

This electrode structure also has a problem that the cost increases since the step of welding the two members 2-1 and 2-2 is needed.

In the case of the electrode structure shown in FIGS. 3(*a*) and 3(*b*), the vertical wall portions of the slit-like recess 1*b* which serves as a portion having a halo suppressing action are shared by the electron beam aperture 1*a*, with the result that the halo suppressing effect is marred. Specifically, as shown in FIG. 4, lines of electric force converge toward the electron beam aperture 1*a*, with the result that a vertical halo suppressing effect decreases and the focusing characteristic is deteriorated.

The plate thickness of the plate member abruptly changes at the intersection (a portion B in FIG. 3(*a*)) of the slit-like recess 1*b* and the electron beam aperture 1*a*, and this abrupt change can cause burrs to occur during manufacture, thereby preventing an electron beam aperture having a good shape from being formed.

An object of the present invention which has been made to solve the above-described various problems of the prior art is to provide an electron gun having an electrode structure in which slit-like recesses are respectively formed in electron beam aperture portions and a decrease in a halo suppressing effect in a longitudinal (vertical) direction can be prevented, particularly in the peripheral portion of a screen, and to provide a color cathode ray tube equipped with such an electron gun.

To achieve the above object, an electron gun according to the present invention includes a triode part including a cathode, a first grid electrode and a second grid electrode, a pre-focusing part including the second grid electrode and a third grid electrode, and a main lens part including at least the third grid electrode, in the order named. The electron beam aperture of at least one grid electrode selected from the first grid electrode and the second grid electrode is a rectangular hole formed in the center of a slit-like recess having longer sides extending in one direction. The width of the rectangular hole in a direction perpendicular to the one direction is greater than the width of the slit-like recess in the direction perpendicular to the one direction.

A color cathode ray tube according to the present invention includes a vacuum envelope including a panel portion having phosphors formed on its internal face, a neck portion which accommodates an electron gun, and a funnel portion which connects the panel portion and the neck portion, and a shadow mask suspended inside the vacuum envelope. In this color cathode ray tube, the electron gun includes a triode part including a cathode, a first grid electrode and a second grid electrode, a pre-focusing part including the second grid electrode and a third grid electrode, and a main lens part including at least the third grid electrode, in the order named. The electron beam aperture of at least one grid electrode selected from the first grid electrode and the second grid electrode is a rectangular hole formed in the center of a slit-shaped recess having longer sides extending in one direction. The width of the rectangular hole in a direction perpendicular to the one direction is greater than the width of the slit-like recess in the direction perpendicular to the one direction.

DETAILED DESCRIPTION OF THE PREFERRED EMBODIMENTS

An electron beam aperture of the present invention has a rectangular shape having sides each of which is slightly greater than the width (i.e., the length of each shorter side) of a slit-like recess. Accordingly, the effective portion of the slit-like recess has vertical walls which are substantially equal in width to the electron beam aperture and which are parallel to each other.

Figure 5:
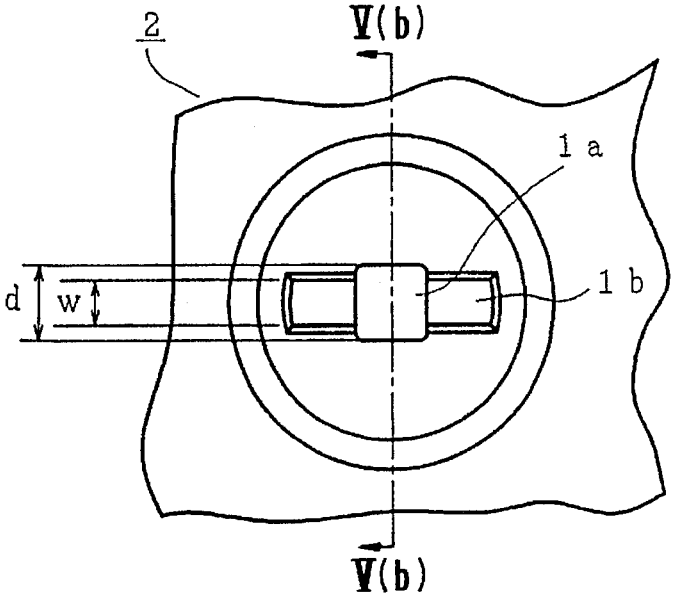
FIGS. 5(*a*) and 5(*b*) are explanatory views partially showing one embodiment of a second grid electrode which constitutes part of an electron gun according to the present invention, FIG. 5(*a*) being a front elevational view and FIG. 5(*b*) being a cross-sectional view taken along the line V(b)—V(b) in FIG. 5(*a*)
Figure 5:
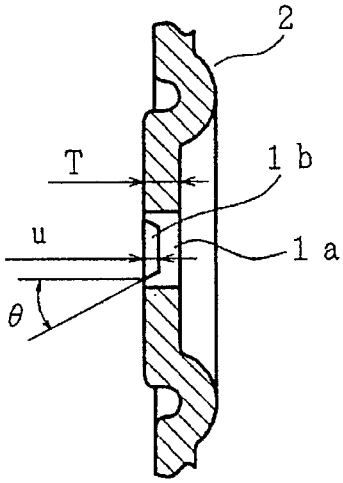
Figure 6:
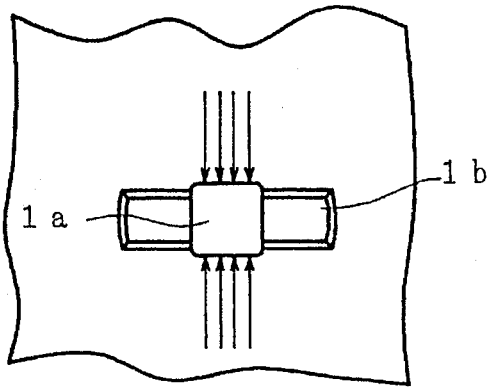
FIG. 6 is an explanatory view of lines of electric force at the second grid electrode according to the present invention.

By adopting such a structure, parallel lines of electric force can be obtained, as shown in FIG. 6. Also, since the effective portion of a slit-like recess 1*b* and an electron beam aperture 1*a* shown in FIGS. 5(*a*) and 5(*b*) are formed in common, it is possible to prevent positional misalignment of the electron beam aperture 1*a* and the slit-like recess 1*b*. Accordingly, the present invention can prevent the unbalance in the effect of suppressing vertical haloes between the upper and lower portions of the electron beam aperture 1*a*.

Since the electron beam aperture 1*a* shown in FIGS. 5(*a*) and 5(*b*) is a rectangular hole, it is possible to reduce the diameter of an electron beam spot without decreasing the luminance of the screen of the cathode ray tube, whereby the focusing characteristic can be improved.

Figure 1:
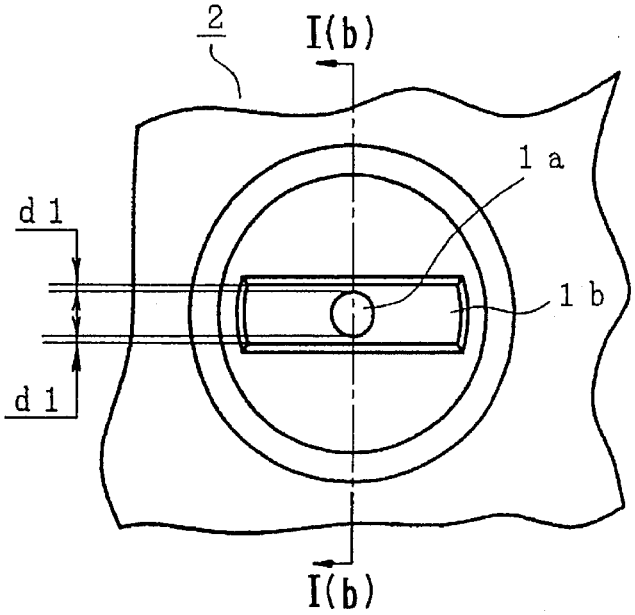
FIG. 1 (a) (PRIOR ART)
FIGS. 1(*a*) and 1(*b*) are explanatory views showing the structure of a second grid electrode used in a conventional electron gun, FIG. 1(*a*) being a front view and FIG. 1(*b*) being a cross-sectional view taken along the line I(b)—I(b) in FIG. 1(*a*)
Figure 1:
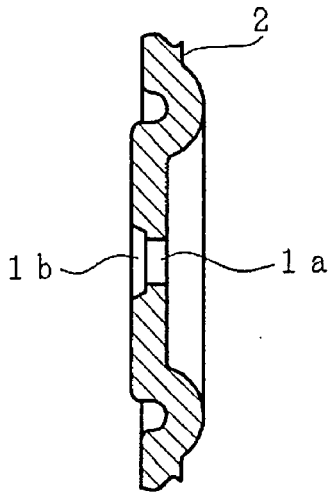
FIG. 1 (b) (PRIOR ART)
Figure 2:
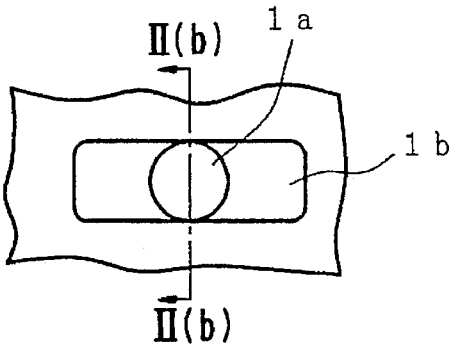
FIG. 2 (a) (PRIOR ART)
FIGS. 2(*a*) and 2(*b*) are explanatory views showing the structure of a second grid electrode used in another conventional electron gun, FIG. 2(*a*) being a front view and FIG. 2(*b*) being a cross-sectional view taken along the line II(b)—II(b) in FIG. 2(*a*)
Figure 2:
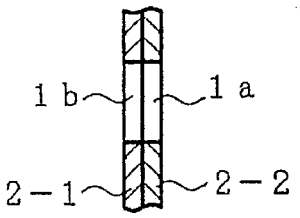
FIG. 2 (b) (PRIOR ART)
Figure 3:
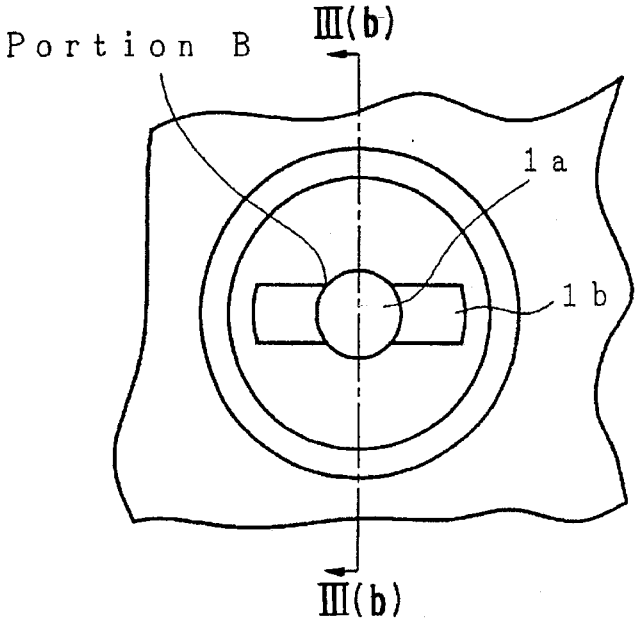
FIG. 3 (a) (PRIOR ART)
FIGS. 3(*a*) and 3(*b*) are explanatory views showing the structure of a second grid electrode used in still another conventional electron gun, FIG. 3(*a*) being a front view and FIG. 3(*b*) being a cross-sectional view taken along the line III(b)—III(b) in FIG. 3(*a*)
Figure 3:
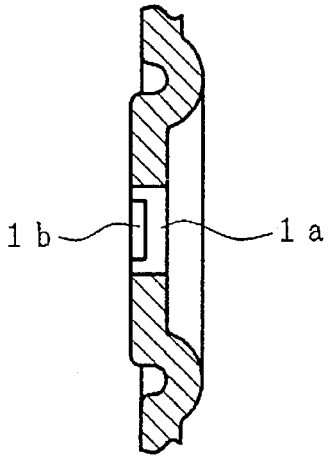
FIG. 3 (b) (PRIOR ART)
Figure 4:
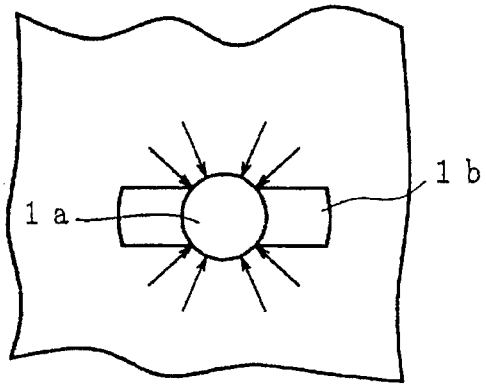
FIG. 4 (PRIOR ART)
FIG. 4 is an explanatory view of the distribution of lines of electric force at the conventional second grid electrode shown in FIG. 3(*a*) and 3(*b*)

Further, as shown in FIGS. 5(*b*), since the wall of the slit-like recess 1*b* is inclined at an angle θ, it is possible to prevent an abrupt change in plate thickness from occurring at the intersection B (see FIG. 3(*a*)) of the electron beam aperture 1*a* and the slit-shaped recess 1*b*, whereby the occurrence of burrs during manufacture can be decreased so that an electron beam aperture having a good shape can be obtained.

EMBODIMENTS

Preferred embodiments of the present invention will be described below with reference to the accompanying drawings.

FIGS. 5(*a*) and 5(*b*) are explanatory views of a first embodiment of an electron gun according to the present invention. FIG. 5(*a*) is a front view of the essential portion of a second grid electrode, and FIG. 5(*b*) is a cross-sectional view taken along the line V(b)—V(b) in FIG. 5(*a*). In FIGS.

5(*a*) and 5(*b*), reference numeral 1*a* denotes an electron beam aperture, reference numeral 1*b* denotes a slit-like recess, and reference numeral 2 denotes the second grid electrode.

As shown in FIG. 5(*a*), the electrode beam aperture 1*a* is rectangular (square), and the length d of each side of the electron beam aperture 1*a* is 0.6 mm and the length w of each shorter side (the width in the vertical direction) at the bottom of the slit-like recess 1*b* is 0.4 mm.

In other words, the dimension d of each side of the electron beam aperture 1*a* is slightly greater than the length w of each shorter side of the slit-like recess 1*b* (d>w). It is preferable that the lengths d and w satisfy the relation 0.5 mm≦d-w≦0.2 mm.

In addition, the wall of the slit-like recess 1*b* is inclined at an angle θ of 18°. It is preferable that this angle θ of inclination be within a range of 10° to 30°.

Incidentally, it is preferable that a depth u of the slit-like recess 1*b* be within a range of 50–80% of the height T of the inner wall of the electron beam aperture 1*a*.

By adopting the above-described electrode structure, it is possible to produce parallel lines of electric force which perpendicularly act on an electron beam passing through the electron beam aperture 1*a* (see FIG. 6).

Also, since the effective portion of the slit-like recess 1*b* and the electron beam aperture 1*a* are formed in common, it is possible to prevent positional misalignment between the electron beam aperture 1*a* and the slit-shaped recess 1*b*. Accordingly, it can prevent the unbalance in the effect of suppressing vertical haloes between the upper and lower portions of the electron beam aperture 1*a*.

Since the electron beam aperture 1*a* is a rectangular hole, it is possible to reduce the diameter of an electron beam spot without decreasing the luminance of the screen of the cathode ray tube and thereby to improve the focusing characteristic.

Further, since the wall of the slit-like recess 1*b* is inclined at the angle θ, it is possible to prevent an abrupt change in plate thickness at the intersection B (see FIG. 3(*a*)) of the electron beam aperture 1*a* and the slit-like recess 1*b*, whereby the occurrence of burrs during manufacture can be decreased so that an electron beam aperture having a good shape can be obtained.

Figure 7:
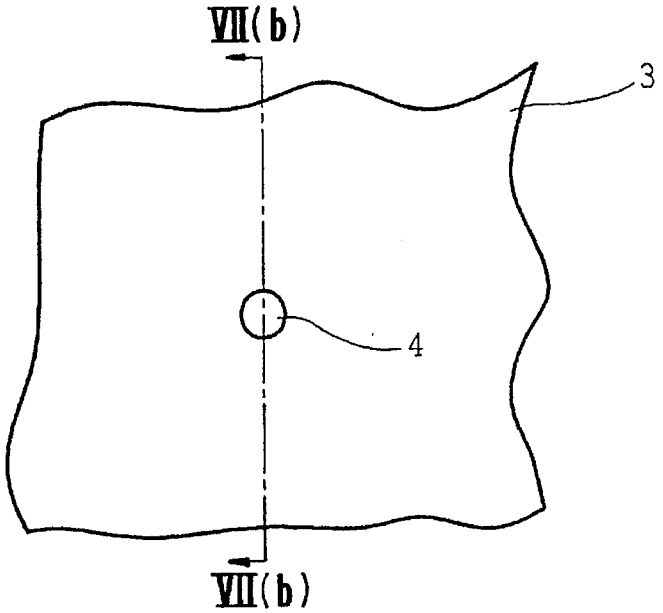
FIGS. 7(*a*) and 7(*b*) are views of one step of a forming process for manufacturing the second grid electrode according to the present invention, FIG. 7(*a*) being a plan view of the essential portion of the second grid electrode and FIG. 7(*b*) being a cross-sectional view taken along the line VII(b)—VII(b) in FIG. 7(*a*)
Figure 7:
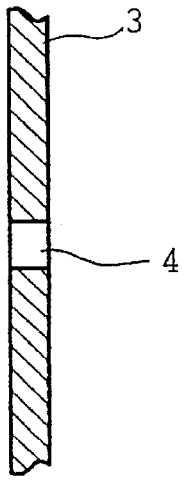

FIGS. 7(*a*), 7(*b*), 8(*a*), 8(*b*), 9(*a*) and 9(*b*) are diagrams illustrating steps of a method for manufacturing the second grid electrode according to the present invention, which has been described with reference to FIGS. 5(*a*) and 5(*b*). FIGS. 7(*a*), 8(*a*) and 9(*a*) are plan views showing the essential portions of the second grid electrode, while FIGS. 7(*b*), 8(*b*) and 9(*b*) are cross-sectional views taken along the lines VII(b)—VII(b), VIII(b)—VIII(b) and IX(b)—IX(b) in the respective figures.

As shown in FIGS. 7(*a*) and 7(*b*), a preliminary hole 4 having a diameter of approximately 0.5 mm is made in a plate 3 having a thickness of approximately 0.4 mm.

Figure 8:
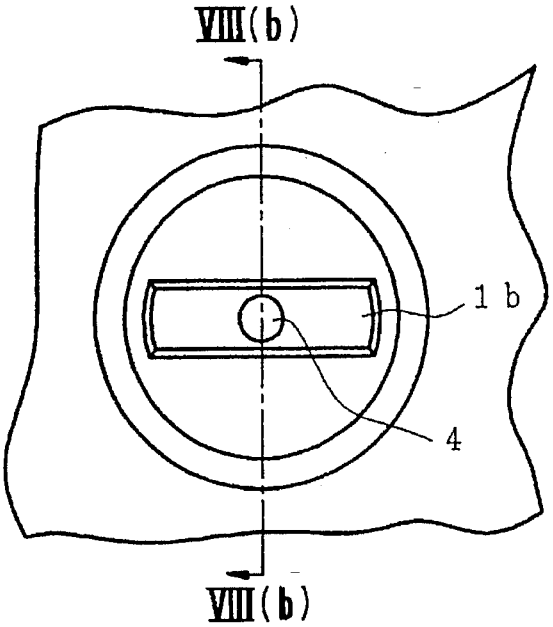
FIGS. 8(*a*) and 8(*b*) are views of another step of the forming process for manufacturing the second grid electrode according to the present invention, FIG. 8(*a*) being a plan view of the essential portion of the second grid electrode and FIG. 8(*b*) being a cross-sectional view taken along the line VIII(b)—VIII(b) in FIG. 8(*a*)
Figure 8:
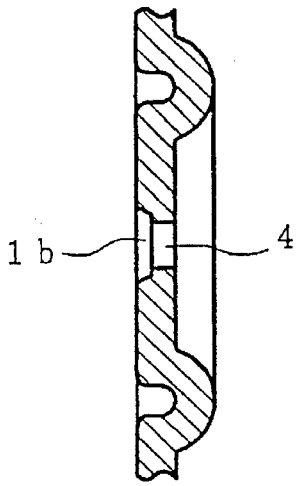

Then, as shown in FIGS. 8(*a*) and 8(*b*), the slit-like recess 1*b* is coined by using a lower machining jig (not shown) having a shape conforming to the shape of the slit-like recess 1*b* and an upper machining jig (not shown) having a flat shape.

Figure 9:
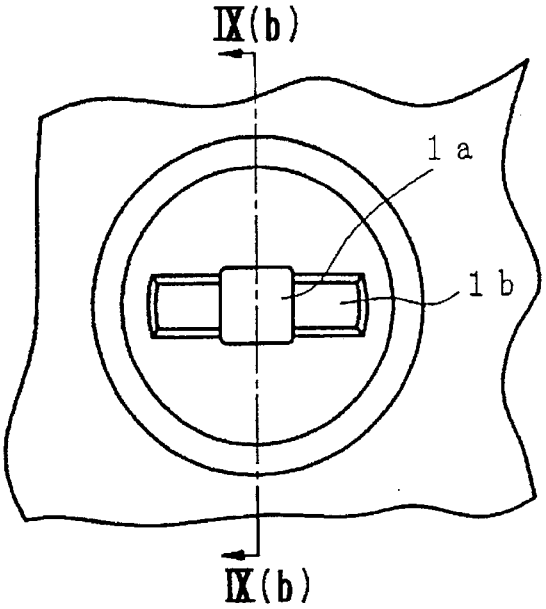
FIGS 9(*a*) and 9(*b*) are views of another step of the forming process for manufacturing the second grid electrode according to the present invention, FIG. 9(*a*) being a plan view of the essential portion of the second grid electrode and FIG. 9(*b*) being a cross-sectional view taken along the line IX(b)—IX(b) in FIG. 9(*a*)
Figure 9:
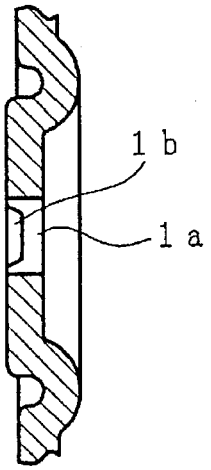

After that, as shown in FIGS. 9(*a*) and 9(*b*), the electron beam aperture 1*a* is punched by using the lower forming jig having the shape conforming to the shape of the slit-like recess 1*b* and an upper forming jig (not shown) conforming to the electron beam aperture 1*a*.

Finally, the plate 3 is punched into the desired exterior shape of the second grid electrode, thereby completing the second grid electrode.

Figure 10:
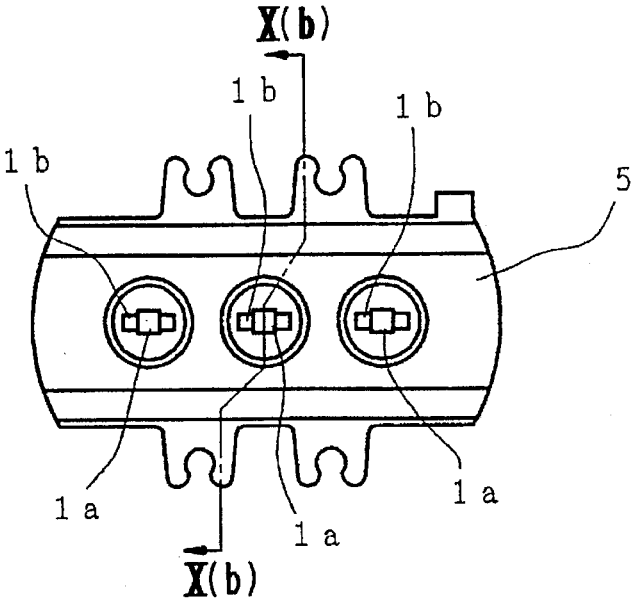
FIGS. 10(*a*) and 10(*b*) are explanatory views showing one example in which the second grid electrode according to the present invention is used as a three-beam-grid electrode, FIG. 10(*a*) being a front view and FIG. 10(*b*) being a cross-sectional view taken along the line X(b)—X(b) in FIG. 10(*a*)
Figure 10:
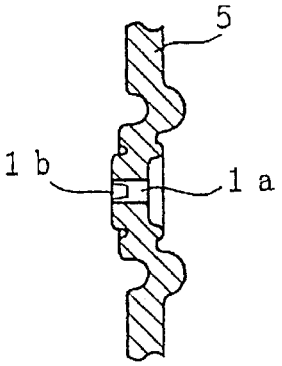

FIGS. 10(*a*) and 10(*b*) are explanatory views showing an example in which the second grid electrode according to the present invention is formed as a grid electrode for an in-line three-electron-beam type electron gun. FIG. 10(*a*) is a front view, and FIG. 10(*b*) is a cross-sectional view taken along the line X(b)—X(b) in FIG. 10(*a*). In this example, the slit-like recess 1*b* is so disposed as to face the first grid electrode.

As shown in FIGS. 10(*a*) and 10(*b*), an in-line type second grid electrode 5 is used in an in-line type color electron gun which includes three electrodes for green (G), blue (B) and red (R) in an integrated form.

Although, in the above-described embodiment, the slit-like recess which extends in the horizontal direction is formed in the second grid electrode, the present invention is not limited to the aforesaid arrangement. For example, by applying the present invention to the first grid electrode, it is possible to provide a good result. Also, by extending the slit-like recess in the vertical direction, it is possible to provide a good result.

Figure 11:
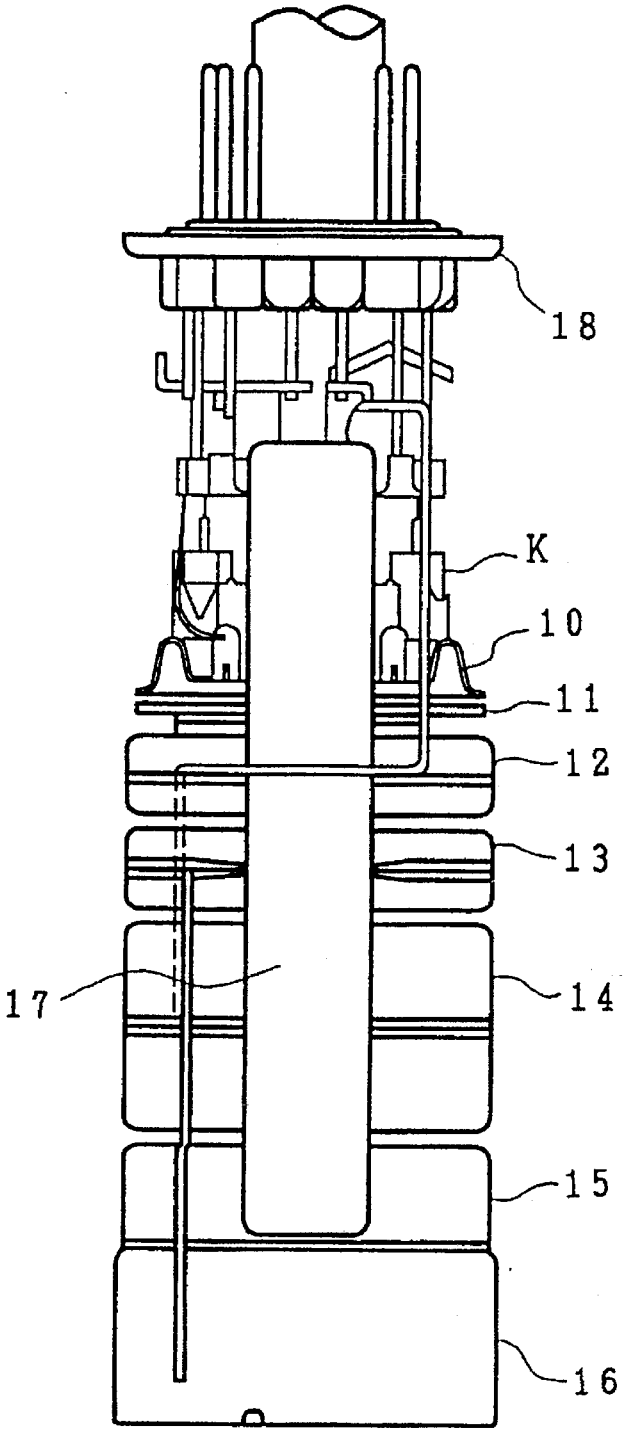
FIG. 11 is an exterior view of an in-line type color electron gun to which the second grid electrode according to the present invention is applied.

FIG. 11 is an exterior view showing the appearance of an in-line type color electron gun in which the second grid electrode according to the present invention is used. A symbol K denotes a cathode, 10 a first grid electrode, 11 a second grid electrode, 12 a third grid electrode, 13 a fourth grid electrode, 14 a fifth grid electrode, 15 a sixth grid electrode, 16 a shield cup, 17 a bead glass and 18 a stem.

The cathode K, the first grid electrode 10 and the second grid electrode 11 constitute a triode part, and the second grid electrode 11 and the third grid electrode 12 constitute a pre-focusing part.

The third to sixth grid electrodes 12 to 15 constitute a main lens, and these electrodes 12 to 15 are integrally fixed by the bead glass 17.

Figure 12:
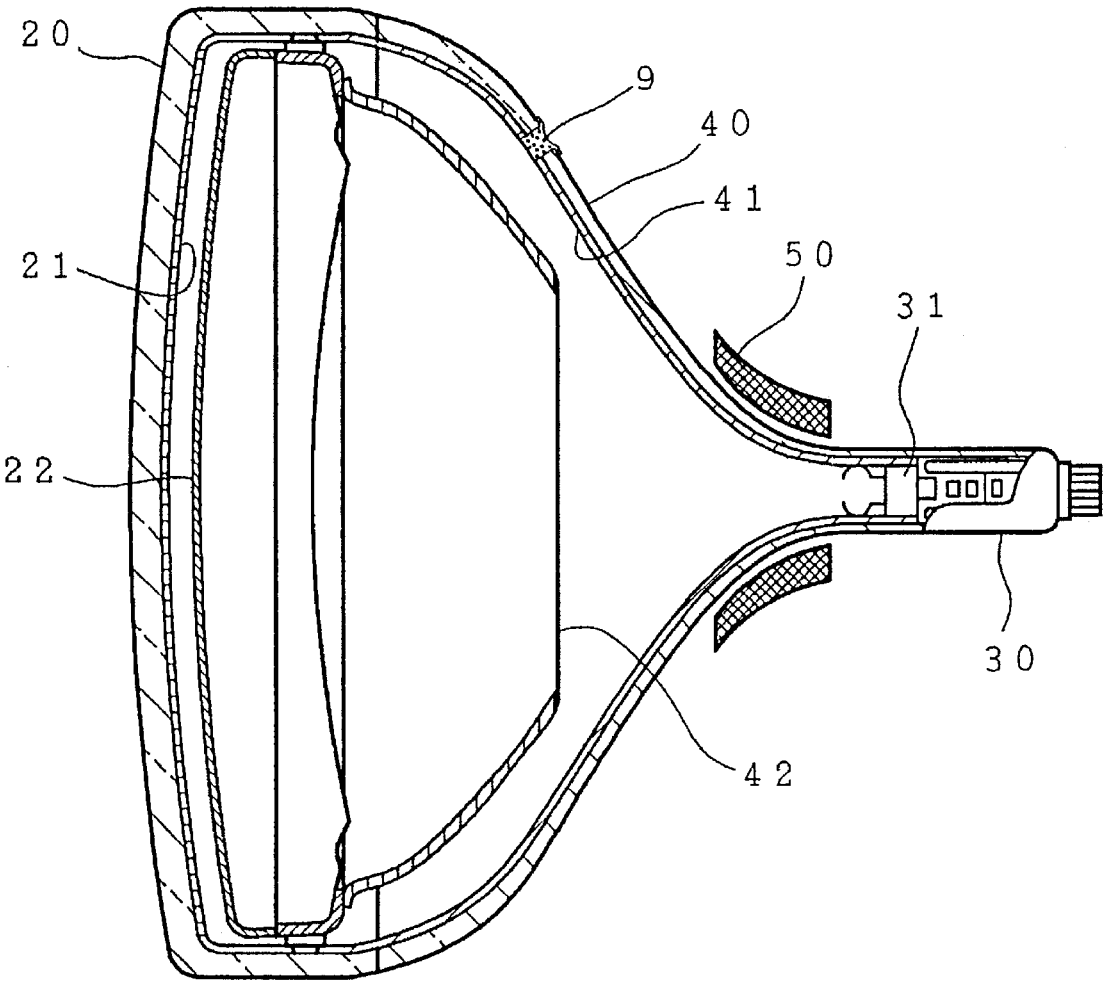
FIG. 12 is a cross-sectional view showing a structure of a color cathode ray tube using the in-line type color electron gun to which the second grid electrode according to the present invention is applied.

FIG. 12 is a cross-sectional view showing an example of the structure of a color cathode ray tube using the in-line type color electron gun to which the second grid electrode according to the present invention is applied. A numeral 9 denotes an anode terminal, 20 a face panel which constitutes a screen, 21 a phosphor screen, 22 a shadow mask, 30 a neck, 31 an electron gun, 40 a funnel, 41 an internal conductive film, 42 a magnetic shield and 50 a deflection yoke.

The electron gun 31 shown in FIG. 12 is the electron gun described above with reference to FIG. 11. Electron beams emitted from the electron gun 31 are deflected in horizontal and vertical directions by the deflection yoke 50, subjected to color selection by the shadow mask 22, and projected onto predetermined phosphors which constitute the phosphor screen 21, thereby forming a color video image.

As described above, in accordance with an example of the present invention, the vertical width of a rectangular electron beam aperture is greater than the vertical width of a slit-like recess extending in the horizontal direction. Accordingly, it is possible to improve the effect of suppressing vertical haloes at the peripheral portion of a phosphor screen, so that the focusing characteristic in the peripheral portions of the screen can be made approximate to that at the center of the screen.

What is claimed is:

1. An electron gun comprising in the order named:

a triode part including a cathode, a first grid electrode, and a second grid electrode;

a pre-focusing part including said second grid electrode and a third grid electrode; and a main lens part including at least said third grid electrode;

wherein an electron beam aperture of at least one grid electrode selected from said first grid electrode and said second grid electrode is a rectangular hole formed in the center of a slit-like recess having longer sides extending in one direction, the width of said rectangular hole in a direction perpendicular to said one direction being greater than the width of said slit-like recess in said direction perpendicular to said one direction.

2. An electron gun according to claim 1, wherein said one direction is a horizontal direction.

3. An electron gun according to claim 1, wherein said at least one grid electrode is said second grid electrode.

4. An electron gun according to claim 3, wherein said slit-like recess is formed in said second grid electrode on the side of said second grid electrode opposing said first grid electrode.

5. A color cathode ray tube comprising:

a vacuum envelope including a panel portion having phosphors formed on an internal face of said panel portion, a neck portion, and a funnel portion connecting said panel portion and said neck portion;

a shadow mask suspended inside said vacuum envelope; and an electron gun disposed in said neck portion, said electron gun including in the order named:

a triode part including a cathode, a first grid electrode, and a second grid electrode;

a pre-focusing part including said second grid electrode and a third grid electrode; and a main lens part including at least said third grid electrode;

wherein an electron beam aperture of at least one grid electrode selected from said first grid electrode and said second grid electrode is a rectangular hole formed in the center of a slit-like recess having longer sides extending in one direction, the width of said rectangular hole in a direction perpendicular to said one direction being greater than the width of said slit-like recess in said direction perpendicular to said one direction.

6. A color cathode ray tube according to claim 5, wherein said one direction is a horizontal direction.

7. A color cathode ray tube according to claim 5, wherein said at least one grid electrode is said second grid electrode.

8. A color cathode ray tube according to claim 7, wherein said slit-like recess is formed in said second grid electrode on the side of said second grid electrode opposing said first grid electrode.

9. A color cathode ray tube according to claim 5, wherein the following relationship is satisfied:

$$0.5\ \text{mm} \leqq d-w \leqq 0.2\ \text{mm}$$

where d represents said width of said rectangular hole in the direction perpendicular to said one direction, and w represents said width of said slit-like recess in the direction perpendicular to said one direction.

10. A color cathode ray tube according to claim 5, wherein said slit-like recess includes a wall inclined at an angle with respect to a line perpendicular to a surface of said at least one grid electrode in which said slit-like recess is formed.

11. A color cathode ray tube according to claim 10, wherein said angle is within a range of 10° to 30°.

12. A color cathode ray tube according to claim 5, wherein said main lens part includes said third grid electrode, a fourth grid electrode, a fifth grid electrode, and a sixth grid electrode.

13. A color cathode ray tube according to claim 5, wherein the depth of said slit-like recess is within a range of 50–80% of the height of an inner wall of said electron beam aperture.

* * * * *